US005335523A

United States Patent [19]

Anastase et al.

[11] Patent Number: 5,335,523

[45] Date of Patent: Aug. 9, 1994

[54] REMOVABLE HEAT EXCHANGER FOR INDUSTRIAL LAUNDRY MACHINES

[75] Inventors: Constantin Anastase; William C. Nehren, both of Wichita Falls; Russell C. Kissick, Plano; Thomas C. Campbell; Jay H. Daily, both of Wichita Falls, all of Tex.

[73] Assignee: White Consolidated Industries, Inc., Cleveland, Ohio

[21] Appl. No.: 954,973

[22] Filed: Sep. 30, 1992

[51] Int. Cl.[5] ..... D06B 23/22

[52] U.S. Cl. ..... 68/16; 68/207; 134/105

[58] Field of Search ..... 165/72, 65, 75, 80.1; 122/235.15, DIG. 11, DIG. 14; 219/523, 536; 392/322, 441, 453, 501, 455, 457, 447; 68/15, 16, 207, 147; 134/105, 107

[56] References Cited

U.S. PATENT DOCUMENTS

| | | | |
|---|---|---|---|
| 1,233,796 | 7/1917 | Lyche | 392/441 |
| 1,420,759 | 6/1922 | Sawicki . | |
| 1,499,605 | 7/1924 | Brown | 68/16 X |
| 1,848,028 | 3/1932 | Ritchie | 392/501 |
| 1,983,836 | 12/1934 | Bergquist | 392/441 |
| 2,279,656 | 4/1942 | Chamberlin et al. . | |
| 2,665,366 | 1/1954 | Cleveland | 392/447 |
| 2,797,567 | 7/1957 | Heien . | |
| 3,286,079 | 11/1966 | Hynes et al. | 392/501 |
| 3,510,250 | 5/1970 | Case et al. | 68/15 |
| 3,673,385 | 6/1972 | Drugmand et al. | 219/523 X |
| 3,741,169 | 6/1973 | Johnson | 122/DIG. 11 X |
| 3,750,429 | 8/1973 | Gorsuch | 68/16 X |
| 4,152,908 | 5/1979 | Bertoldi . | |
| 4,356,385 | 10/1982 | Stein et al. | 392/447 |
| 4,376,378 | 3/1983 | Svenningsen . | |
| 4,593,178 | 6/1986 | Banta et al. | 392/453 |

FOREIGN PATENT DOCUMENTS

| | | | |
|---|---|---|---|
| 106364 | 3/1927 | Austria | 68/16 |
| 508766 | 10/1920 | France | 122/DIG. 11 |
| 1327242 | 4/1963 | France | 68/16 |
| 395433 | 7/1933 | United Kingdom | 68/16 |
| 739779 | 11/1955 | United Kingdom | 392/453 |
| 1352955 | 5/1974 | United Kingdom | 68/16 |

*Primary Examiner*—Frankie L. Stinson

*Attorney, Agent, or Firm*—Pearne, Gordon, McCoy & Granger

[57] ABSTRACT

The present invention is directed towards a removable heat exchanger for a fabric treating machine. The machine generally includes a perforated spin tub and an imperforate outer shell. In one embodiment the heat exchangers, which are removably mounted to an inner surface of the outer shell, are guided during installation and removal by guide clips. Spacers maintain the heat exchangers a predetermined distance from the inner surface of the outer shell. Retainer clips are provided to releasably retain the heat exchanger in position relative to the spin tub during operation of the machine. In a second embodiment the heat exchangers, which are mounted within side pockets provided by the outer shell. In both the first and second embodiments, the heat exchangers are held in place by jacking bolts. The removable heat exchanger of the present invention improves upon welded-in-place internal heat exchangers and external heat exchangers.

20 Claims; 4 Drawing Sheets

REMOVABLE HEAT EXCHANGER FOR INDUSTRIAL LAUNDRY MACHINES

BACKGROUND OF THE INVENTION

1. Field of the Invention

The present invention generally relates to textile treating machines and, more particularly, to heat exchangers for industrial or institutional fabric treating machines.

2. Description of the Related Art

In industrial or institutional fabric treating machines, and continuous batch laundry systems (tunnels), a large volume of liquid is required to treat the fabrics. Since such a large quantity of liquid is used, preliminary heating of the treating liquid prior to its introduction into the machine, which is conventional in smaller household machines, is neither economically nor operationally practical.

Therefore, in conventional fabric treating machines, treating liquid is introduced into the imperforate outer tub or shell and thereafter heated to the desired temperature. The process for heating the treating liquid bath, and for subsequently maintaining the bath at a desired temperature, has generally been accomplished by one of two known methods.

The first known method of heating uses a series of pipes to carry the treating liquid to an external heater where it is heated and thereafter returned to the fabric treating machine. The treating liquid is maintained at the required temperature for treating the fabrics by continuous recirculation and heating.

In heating methods of this type, an extra ten to twenty percent of treating liquid is required to maintain the bath volume and temperature within the desired operating range. However, due to the small amount of treating liquid heated at one time, there is a tendency for undesirable temperature spikes or gradients to develope within the treating liquid bath.

Heating methods of this type suffer from the further disadvantage that they are generally inefficient, losing a certain amount of the heat acquired from the external heater while returning to the fabric treating machine. Insulation is required to minimize conduction losses. Also, the continuous circulation of treating liquid requires auxiliary equipment such as pumps, hoses, valves and fittings, increasing the product cost and further decreasing efficiency.

The second known method of heating uses a heat exchanger attached to the inside of the fabric treating machine. Heat exchangers of this type generally include a series of conduits to carry a heat exchanging fluid through the fabric treating machine. The known heat exchangers used in this method of heating are permanently welded to the inside surface of the imperforate outer shell intermediate the outer tub and the perforate spin tub.

Welded-in-place heat exchangers are susceptible to cracking and corrosion which requires costly and time-consuming repair or replacement. Furthermore, during repair, maintenance, or cleaning, the spin tub must be removed to gain access to the heat exchanger, a very costly and labor intensive procedure which takes the machine out of service for an extended period of time. Thus, heat exchangers of this type suffer from the disadvantage that they are not easily accessible when maintenance is required and that the machine is inoperable during repair of the heat exchangers.

Therefore, there exists a need in the art for an efficient heat exchanger which is easily accessible to allow quick repair and replacement thereof.

SUMMARY OF THE INVENTION

The present invention relates to a heat exchanger for a fabric treating machine which is easily removed from the machine for replacement or repair.

In accordance with the present invention, the fabric treating machine provides a perforate spin tub and an imperforate outer shell. The ends of the outer shell are covered by front and rear shell heads. In a first embodiment, the front shell head has removably mounted thereto heat exchanger access covers.

The heat exchanger access covers of the first embodiment are integrally attached to the heat exchangers such that, when the access covers are attached to the front head, the heat exchangers are positively mounted within the fabric treating machine. The access covers provide inlet and outlet ports for the communication of a heat exchanging medium with the heat exchangers.

The heat exchanger of the first embodiment is mounted to the inner surface of the outer shell by a mounting means. The mounting means includes guide clips which assist the user in sliding the heat exchanger into and out of the washing machine and retainer clips which cooperate with the guide clips to retain the heat exchanger in position relative to the spin tub during operation of the machine. The heat exchanger integrally includes a plurality of spacers which keep the heat exchanger a predetermined distance from the inner surface of the outer shell. A plurality of jacking bolts are included to urge the heat exchanger towards the mounting means.

In a second embodiment, the heat exchangers are mounted within coil side pockets provided by the outer shell. The heat exchanger of the second embodiment integrally includes an access cover which sealing attaches to an upper surface of the side pocket. Mounting means are provided to mount the heat exchanger to the side pocket.

In accordance with the present invention, efficient heating of a treating liquid bath is provided while the heat exchanger is easily and quickly removable from the machine for repair or replacement. In the preferred embodiments of the invention there are two heat exchangers per fabric treating machine. In either embodiment, the fabric treating machine is operable when one heat exchanger is removed from the machine by covering the access opening, which previously had the access cover attached thereto, with a blank. In this fashion, the washing machine is operable when one of the heat exchangers is being repaired, reducing or eliminating the downtime associated with heat exchanger maintenance.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
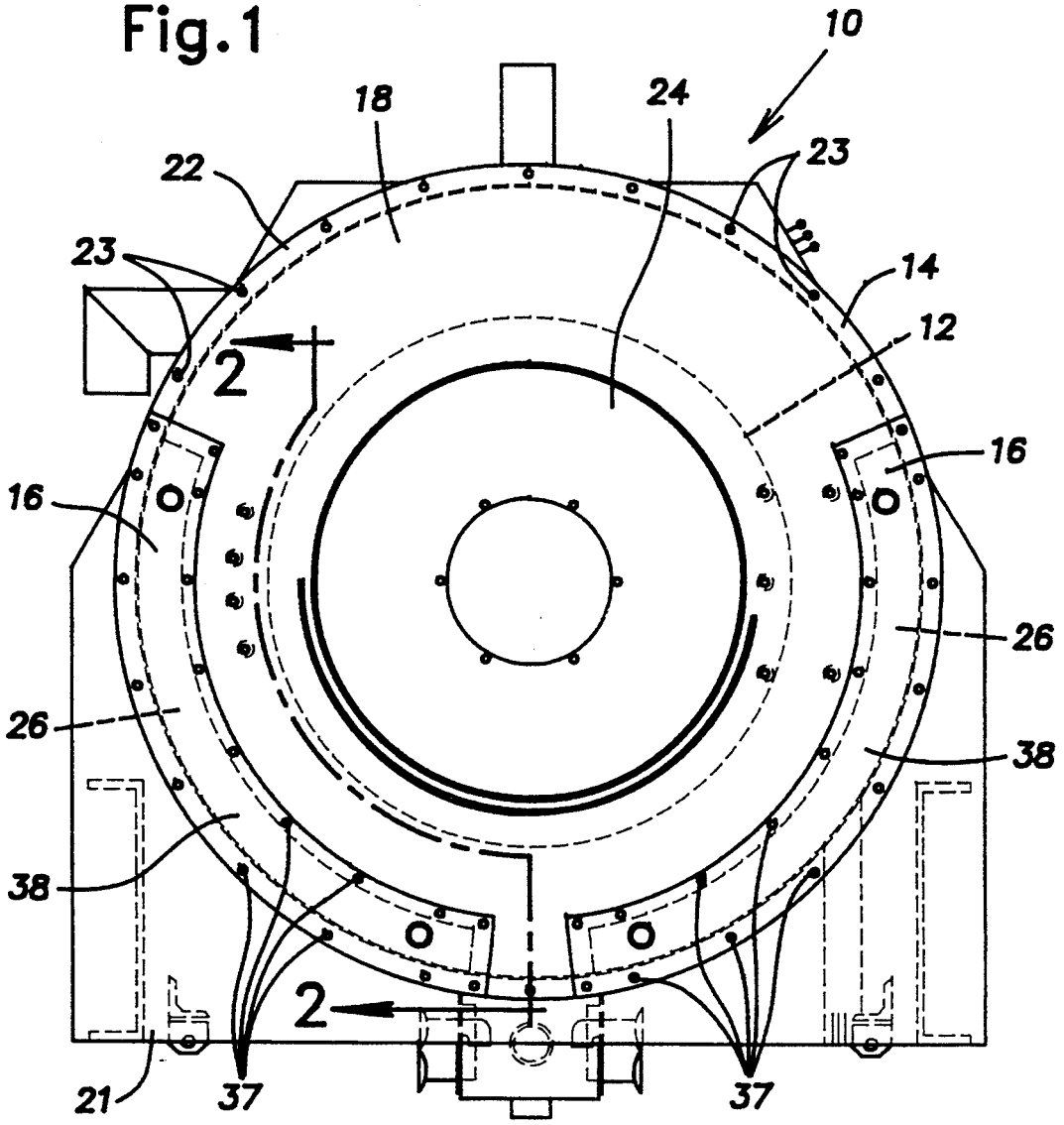
FIG. 1 is a front elevational view of the fabric treating machine in accordance with the present invention.

With reference FIGS. 1–5, a fabric treating machine 10 according to a first embodiment of the present invention is shown. The machine 10, which is designed for use as a washing machine, stone-washing machine, textile dyeing machine, or the like, includes a perforate spin tub 12, an imperforate outer shell 14, and a pair of removable heat exchangers 16. One particular use of the present invention is for an enzyme treatment machine such as is disclosed in application Ser. No. 07/943,495 filed Sep. 11, 1992, the disclosure of which is expressly incorporated herein by reference.

The spin tub 12 and outer shell 14 are generally cylindrical, the spin tub 12 having an open front end and a closed rear end. The outer shell 14 is defined by a cylindrical body having open front and rear ends which are closed by a front shell head 18 and a rear shell head 20, respectively. As illustrated, the machine 10 includes a frame 21 which supports the outer shell 14.

The rear shell head 20 is permanently attached, by welding or the like, to the outer shell 14. The front end of the outer shell 14 includes an annular flange 22. The annular flange provides a series of fastener receiving holes (not shown) which allow the front shell head 18 to be removably attached to the outer shell 14. The front shell head 18 is generally ring-shaped, having a plurality of fastener receiving holes 23 disposed along the perimeter edge thereof. The fastener receiving holes align with the holes in the annular flange 22 to allow the front shell head and the outer shell to be attached by conventional fasteners, as shown best in FIG. 1.

The front shell head 18 includes a central circular opening 24 and a pair of arcuate openings 26. The arcuate openings are spaced inwardly from an outer edge of the front shell head 18 a distance generally equal to the width of the annular flange 22. The central opening 24 is provided to allow access to the interior of the spin tub 12 via a pivotally mounted door (not shown).

The arcuate openings 26 are designed to slidably receive the heat exchangers 16. A series of fastener receiving holes (not shown) disposed at regular intervals around the arcuate openings 26 matingly align with holes 37 provided in an access cover 38 of the heat exchanger 16 to allow the access cover 38 and the front shell head 18 to be attached by conventional fastening means, as will be described more fully hereafter. The relatively outwardly displaced fastener receiving holes around the arcuate openings 26 also align with holes in the access cover 38 and the annular flange 22, allowing the outer shell 14, front shell head 18, and the access cover 38 to be interconnected by conventional fasteners.

The heat exchangers 16, which are generally known in the art as plate-type or platecoil heat exchangers, are shown best in FIGS. 2–5. The heat exchangers are formed by pressing a pair of metal sheets together to form an integral plate having a plurality of internal passageways 28, an inlet manifold 30, and an outlet manifold 32, allowing a heat exchanging medium to circulate within the heat exchanger 16.

A flange 34 is provided along the perimeter of the heat exchanger 16. The flange 34 has extending therefrom a plurality of outwardly extending spacers 36. The spacers 36, which, when the heat exchanger 16 is mounted in the machine 10, are located between the heat exchanger and the inner surface of the outer shell 14, maintain the heat exchanger a distance from the outer shell.

The access cover 38 has extending outwardly therefrom an inlet port connection 40 and an outlet port connection 42. The inlet port connection 40 receives the heat exchanging medium from the heater (not shown) and communicates it to the inlet manifold 30 for circulation throughout the heat exchanger 16. The outlet port connection 42 receives the circulated heat exchanging medium from the outlet manifold 32 and communicates it to the heater.

By forming the heat exchanger 16 as a platecoil, the problems associated with lint, threads and the like becoming entangled on the heat exchanger are minimized while surface area and heat transfer are increased. Also, by maintaining the heat exchanger a distance from the outer shell 14, treating liquid can circulate along both sides of the heat exchanger, thereby maximizing heat transfer and preventing lint or other undesirable material from collecting on the heat exchanger.

Figure 2:
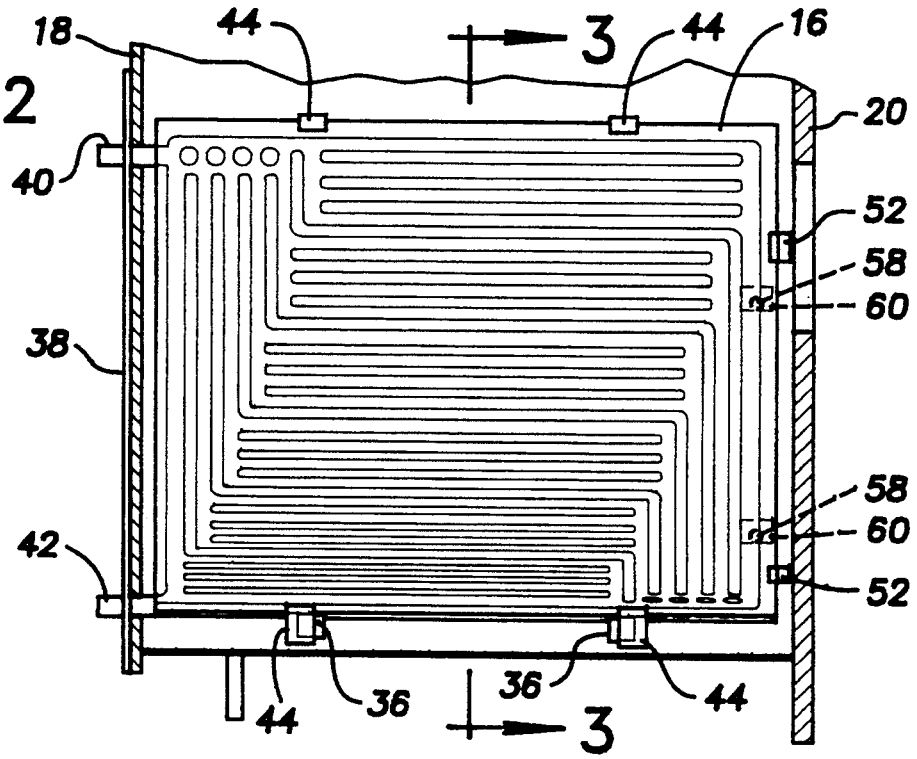
FIG. 2 is a side elevational view, in cross section, taken along line 2—2 of FIG. 1.
Figure 3:
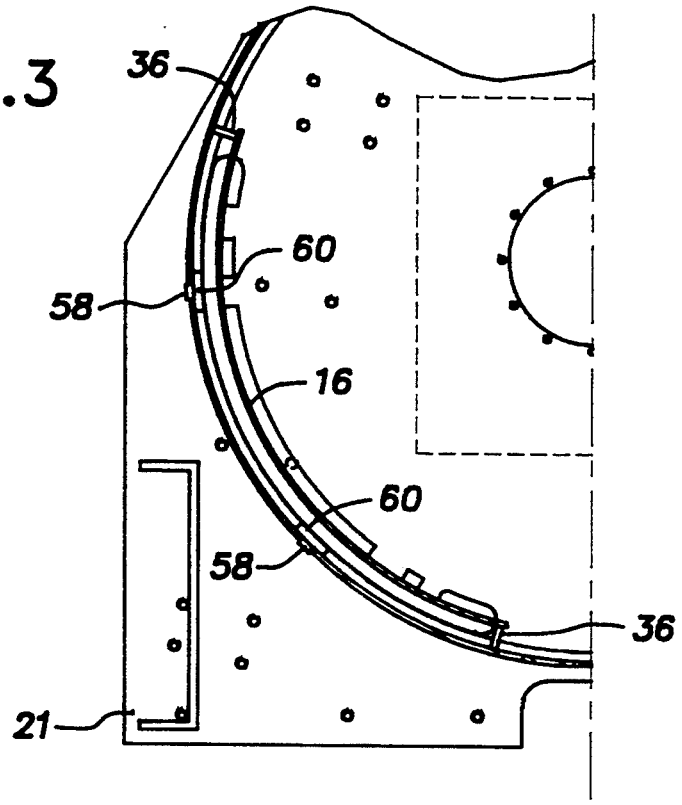
FIG. 3 is a front elevational view, in cross section, taken along line 3—3 of FIG. 2.
Figure 4:
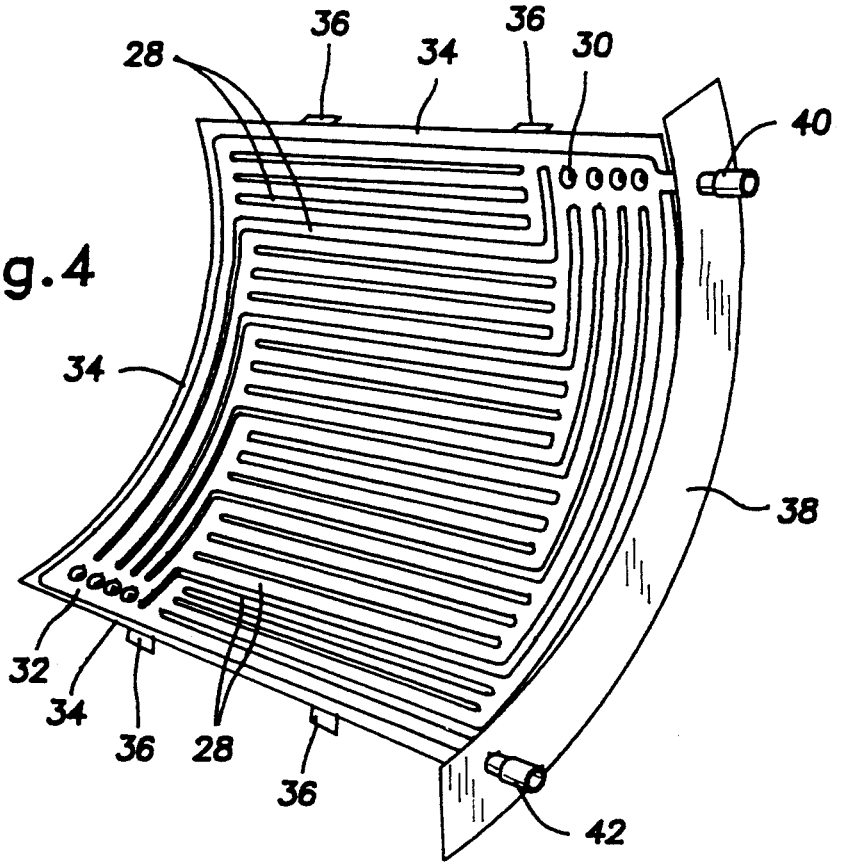
FIG. 4 is a perspective view of the heat exchanger of the present invention.
Figure 5:
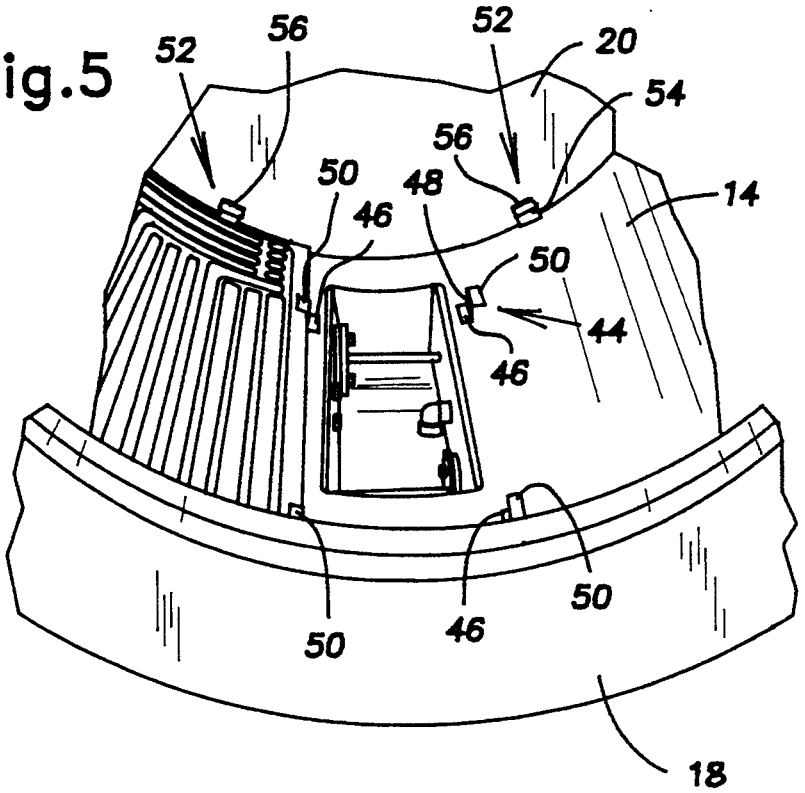
FIG. 5 is a perspective view through the center opening in the front shell head of the interior of the imperforate outer shell, with portions broken away, and with the spin tub and one of the heat exchangers removed.

With specific reference to FIG. 5, the inner surface of the outer shell 14 is shown to provide a series of guide clips 44. The guide clips are generally Z-shaped, having a lower leg 46 that is welded or otherwise permanently attached to the outer shell 14, an arm 48 that extends radially inward from the outer shell, and an upper leg 50 that is directed towards the heat exchanger 16. As illustrated, the upper and lower legs 50 and 46 are oppositely directed. Preferably, four guide clips 44 are provided to slidably receive each heat exchanger 16, two relatively above and two relatively below the heat exchanger, as illustrated in FIG. 2.

The upper leg 50 of the guide clip 44 engages the flange 34 of the heat exchanger 16 when the heat exchanger is mounted within the machine 10. Naturally, the present invention is not limited to the number and specific shape of the guide clips disclosed herein, the specific features merely being described to illustrate one of the preferred embodiments of the invention presently contemplated by the inventors.

The rear shell head 20 provides a series of retainer clips 52 on its inner surface which cooperate with the guide clips 44 to retain the heat exchanger in position relative to the spin tub 12 and outer shell 14. The retainer clips 52 are generally L-shaped, having a leg 54 which is welded or otherwise permanently attached to the inner surface of the rear shell head 20 and an inwardly extending arm 56 which engages the perimeter flange 34 provided by the heat exchanger.

A pair of jacking bolts 58 extend through the outer shell 14 near the rear shell head 20 to engage the heat exchanger 16. The jacking bolts include a pad 60 on the interior of the outer shell which contacts the heat exchanger 16. Deploying the jacking bolts 58 forces the heat exchanger 16 relatively away from the inner surface of the outer shell 14 and towards the retainer clips 52, trapping the heat exchanger between the arms 56 of the retainer clips 52 and the pads 60, and reducing or eliminating vibration of the heat exchanger 16 during operation of the machine 10.

The heat exchanger 16 is preliminarily mounted to the outer shell 14 by sliding the heat exchanger through the arcuate opening 26 and along the guide clips 44 toward the rear shell head 20. When the access cover 38 engages the front shell head 18, the heat exchanger is properly positioned within the machine 10 and preliminary mounting of the heat exchanger is complete.

Preferably, the spacers 36 are located on the heat exchangers 16 such that they are underneath the upper leg 50 of the guide clips 44 at this time, ensuring a tight and secure fit between the heat exchanger 16 and the guide clips 44. Deploying the jacking bolts 58 traps the heat exchanger 16 between the pads 60 and the retainer clips 52. Hence, the combination of spacers 36, guide clips 44, jacking bolts 58, and retainer clips 52 firmly yet removably mounts the heat exchanger 16 to the outer shell 14.

At this point, fasteners can be inserted through the holes in the access cover 38 to securely attach the heat exchanger 16 to the machine 10. As noted earlier, some of the fasteners attach the access cover 38 and the front shell head 18, while others attach the access cover 38, front shell head 18, and the flange 22 of the outer shell 14. Naturally, a gasket (not shown) or other known sealing means is used to prevent treating liquid or steam from leaking out of the connection between the access cover 38 and the front shell head 18.

Once the heat exchanger 16 is secured to the machine 10, the necessary piping connections are made to fluidly connect the inlet and outlet to the heater. The pair of heat exchangers 16 can be connected in parallel, or operated independently, as desired.

To remove one of the heat exchangers 16 for repair or maintenance, the pipes (not shown) are disconnected from the inlet and outlet port connections 40, 42, the jacking bolts 58 are loosened, the fasteners are removed from the heat exchanger access cover 38, and the heat exchanger 16 is pulled out of the machine 10.

If it is desired to operate the machine with only one heat exchanger, a blank access cover (not shown) is mounted on the front shell head 18 to cover the arcuate opening 26 therein. The blank access cover is identical to the access cover 38 attached to the heat exchanger 16 which was previously removed, except for the inlet and outlet port connections 40, 42. Therefore, this changeover can take place in a short time and allow further use of the machine during repair of the heat exchanger.

Figure 6:
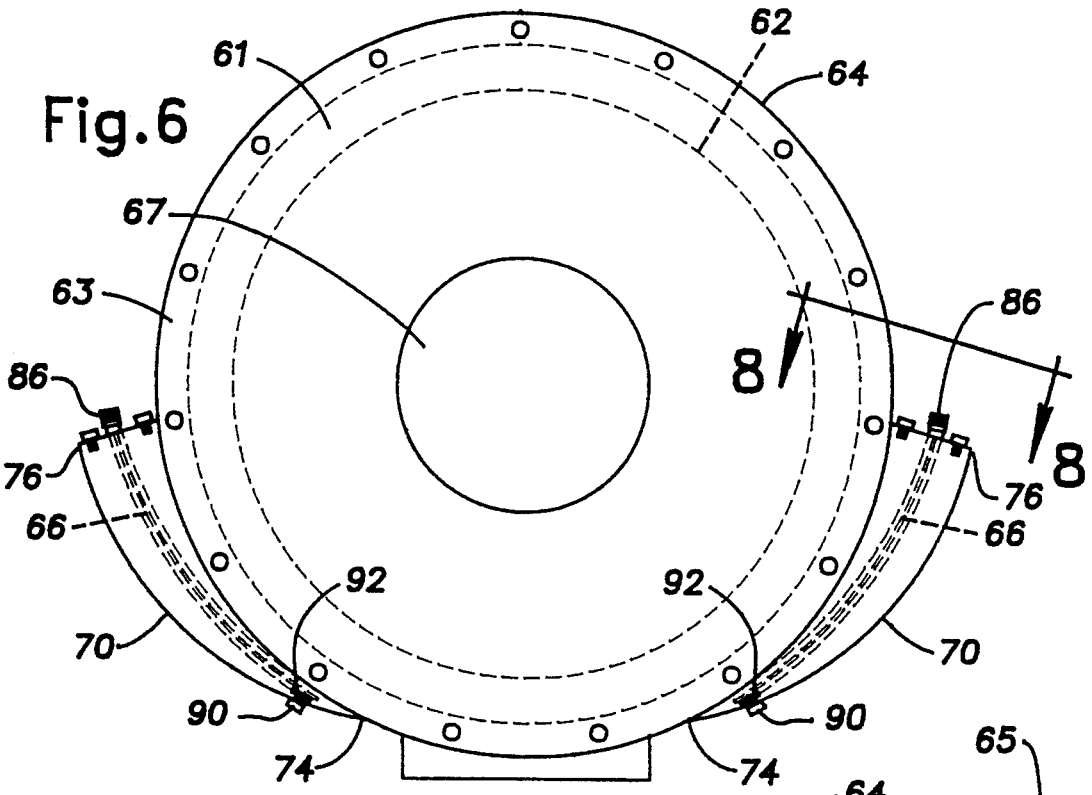
FIG. 6 is a front elevational view of a fabric treating machine in accordance with a second embodiment of the present invention.
Figure 7:
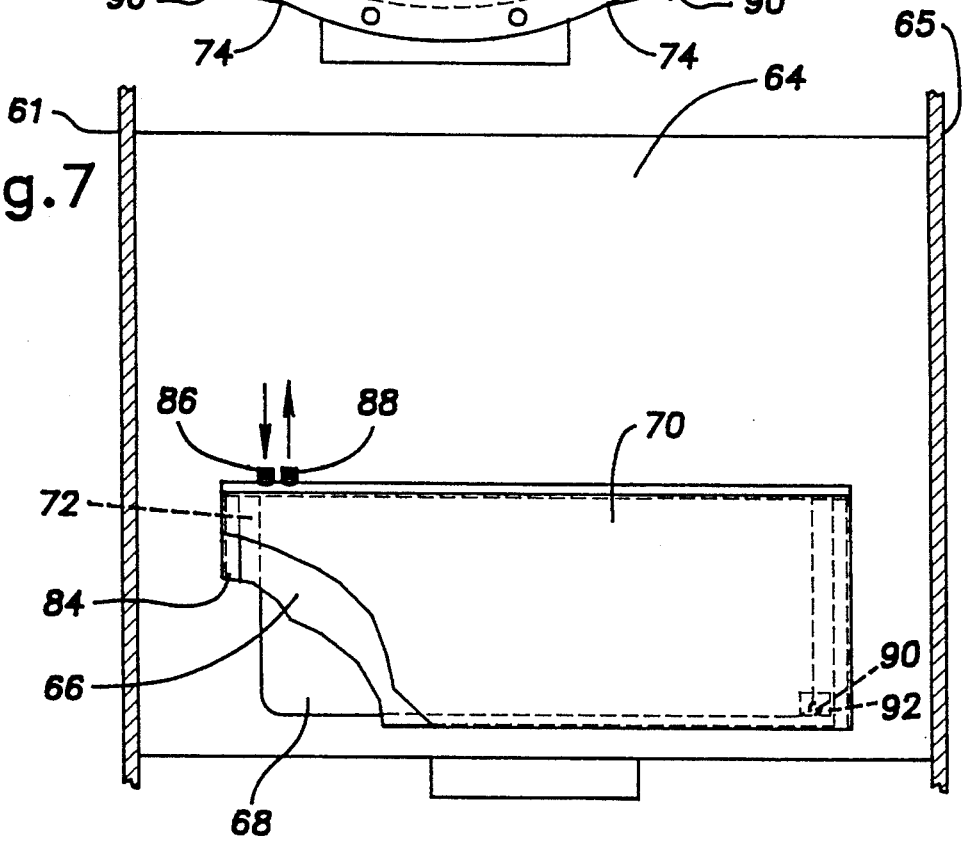
FIG. 7 is a side elevational view, with parts broken away, of the second embodiment of the present invention; and, FIG. 8 is a top plan view taken along lines 8—8 of FIG. 6 of the access cover of the second embodiment of the present invention.
Figure 8:
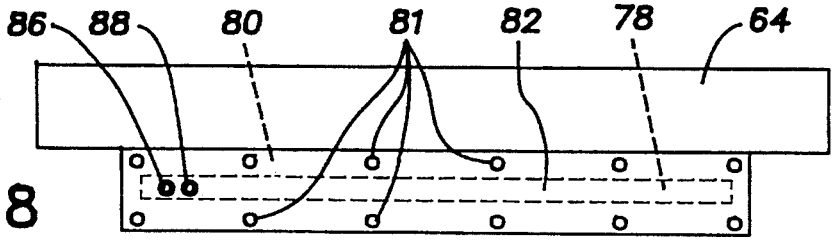

A second embodiment of the present invention is illustrated in FIGS. 6–8, wherein is shown an alternate heat exchanger mounting arrangement, the heat exchangers being accessible from the side of the machine, rather than the front.

As illustrated, the fabric treating machine 10 of the second embodiment generally includes a perforate spin tub 62, an imperforate outer shell 64 and a pair of heat exchangers 66. The outer shell has front and rear ends which are covered by front and rear shell heads 61 and 65, respectively. The outer shell 64 includes an annular front flange 63 to which the front shell head 61 is attached. The front shell head 61 provides a circular opening 67 for access into the interior of the spin tub 62.

The imperforate outer shell 64 has generally rectangular apertures 68 cut in opposite sides thereof. The apertures 68 are covered by outwardly extending coil side pockets 70 which are welded or otherwise permanently attached to the outer shell 14. A rim 72 is defined by the portion of the outer shell between the hole 68 and the side pocket 70 and assists in mounting the heat exchanger 66 within the side pocket 70, as will be described more fully hereinafter.

Each of the coil side pockets 70 is arcuate, and includes a lower end 74 which generally merges with the outer shell 64 and an upper end 76 which is outwardly spaced from the outer shell 64.

The upper end 76 of each coil side pocket 70 provides an upwardly directed rectangular opening 78 which is designed to slidably receive the heat exchanger 66. Surrounding the upwardly directed opening 78 is a flange 80 which provides a plurality of fastener receiving holes (not shown). The fastener receiving holes matingly align with similar holes 81 in a heat exchanger access cover 82 to allow conventional fasteners to be inserted therethrough and thereby attach the heat exchanger 66 to the machine 10. The flange 80 supports the access cover 82, as will be apparent from the following description.

The construction of the heat exchangers 66, and the communication of heat exchanging medium throughout the heat exchanger, is generally identical to the heat exchanger 16 of the first embodiment, including a perimeter flange 84, inlet and outlet port connections 86 and 88, inlet and outlet manifolds (not shown), and a plurality of internal passageways (not shown), and will not be further discussed herein.

A pair of jacking bolts 90 extend through the coil side pocket 70 to engage the heat exchanger 66. As in the first embodiment, each of the jacking bolts 90 includes a pad 92 which contacts the heat exchanger 66. Deploying the jacking bolts 90 forces the heat exchanger 66 toward the outer shell 64, and traps the perimeter flange 84 provided by the heat exchanger between the rim 72 and the pads 92 and reduces or eliminates vibration of the heat exchanger 66 during operation of the machine.

The heat exchanger of the second embodiment is mounted to the machine 10 by downwardly sliding the heat exchanger 66 through the upwardly directed rectangular opening 78 in the coil side pocket 70 until the access cover 82 contacts the flange 80 therearound. In this position, the perimeter flange 84 of the heat exchanger is generally received between the side pocket 70 and the rim 72 surrounding the rectangular aperture 68 in the outer shell 14. Thereafter, the jacking bolts 90 are deployed, trapping the flange 84 of the heat exchanger between the pads 92 and the rim 72. Conventional fasteners are used to connect the access cover 82 of the heat exchanger 66 to the coil side pocket 70. Thereafter the heat exchanger inlet and outlet port connections 86 and 88 are connected to the external heater (not shown) to allow fluid communication between the heater and the heat exchanger.

Removal of the heat exchanger of the second embodiment for repair or replacement is accomplished by disconnecting the pipes (not shown) from the inlet and outlet port connections 86 and 88, removing the fasteners from the access cover 82, loosening the jacking bolts 90, and upwardly sliding the heat exchanger 66 out of the coil side pockets 70.

Since the heat exchanger is not mounted between the outer shell 64 and the spin tub 62, the second embodiment of the invention allows the outer diameter of the spin tub to be closer to the inner diameter of the outer shell. Hence, the second embodiment combines the spacial advantages of externally heating the treating liquid bath with the operational and efficiency advantages of internal heat exchangers, all while providing an efficient and easily removable heat exchanger. Treating liquid circulates on opposite sides of the heat exchanger 66, maximizing heat transfer and preventing lint from collecting on the heat exchanger. As in the first embodiment, a blank access cover (not shown) covers the opening 78 in the upper end 76 of the coil side pocket 70 to allow the machine to operate with only one heat exchanger.

It should be clear that the disclosed invention is of the type that is capable of various modifications without departing from the scope and spirit of present invention. Therefore, while the preferred embodiments of the present invention are shown and described herein, it is to be understood that the same is not so limited but shall cover and include any and all modifications thereof which fall within the purview of the invention.

What is claimed is:

1. A fabric treating machine, comprising:

an outer shell and a perforated spin tub, said outer shell including a front shell head, a rear shell head, and a cylindrical body intermediate said front and rear shell heads;

means for removably mounting a platecoil-type heat exchanger to an inner surface of the cylindrical body of the outer shell, said mounting means being operable to slidably mount the heat exchanger within the machine and secure the head exchanger to the inner surface of the outer shell body, said heat exchanger being spaced a distance from the outer shell to allow a treating liquid to circulate on opposite sides of said heat exchanger; and, a heat exchanger access cover, said access cover being removably attached to the outer shell and providing inlet and outlet ports to communicate a heat exchanging medium between an interior of the heat exchanger and an external heat source.

2. A fabric treating machine as in claim 1, wherein the heat exchanger includes an access cover, said access cover being attached to the front shell head.

3. A fabric treating machine as in claim 2, wherein the mounting means includes a guide clip, said guide clip being secured to the inner surface of the outer shell body and slidably engaging the heat exchanger during insertion and removal thereof.

4. A fabric treating machine according to claim 3, wherein the mounting means further includes a retention clip, said retention clip being secured to the rear shell head and engaging and retaining the heat exchanger in position relative to the spin tub.

5. A fabric treating machine according to claim 4, wherein the heat exchanger integrally includes a spacer, said spacer being in engagement with the inner surface of the outer shell body and operable to space the heat exchanger a distance from the outer shell.

6. A fabric treating machine according to claim 5, wherein the spacer is generally opposite the guide clip, the heat exchanger being received between the spacer and guide clip to prevent movement of the heat exchanger relative to the spin tub.

7. A fabric treating machine according to claim 2, wherein the heat exchanger integrally includes a spacer, said spacer being in engagement with the inner surface of the outer shell body and operable to space the heat exchanger a distance from the outer shell.

8. A fabric treating machine according to claim 7, wherein the mounting means includes a guide clip which is secured to the inner surface of the outer shell body, said spacer being generally opposite the guide clip, the heat exchanger being received between the spacer and guide clip to prevent movement of the heat exchanger relative to the spin tub.

9. A fabric treating machine according to claim 8, wherein the mounting means further includes a jacking bolt which extends through said outer shell, the heat exchanger being trapped between the jacking bolt and a retainer clip.

10. A fabric treating machine according to claim 9, wherein the retainer clip is secured to the rear shell head.

11. A fabric treating machine, comprising:

an outer shell and a perforated spin tub, said outer shell including a front shell head, a rear shell head, and a cylindrical body intermediate said front and rear shell heads;

means for removably mounting a platecoil-type heat exchanger to a surface of the cylindrical body of the outer shell, said mounting means being operable to slidably receive the heat exchanger and maintain at least a portion of the heat exchanger a distance from the outer shell to allow a treating liquid to circulate on opposite sides of said heat exchanger; and, a heat exchanger access cover, said access cover being removably attached to the outer shell and providing inlet and outlet ports to communicate a heat exchanging medium between an interior of the heat exchanger and an external heat source, wherein an aperture is formed in the outer shell, said outer shell comprising a side pocket which generally surrounds said aperture, said heat exchanger being slidably and removably received between said outer shell and said side pocket.

12. A fabric treating machine according to claim 11, wherein the heat exchanger includes an access cover, said access cover being removably secured to the side pocket.

13. A fabric treating machine according to claim 12, wherein a rim is provided by the outer shell body, said rim surrounds the aperture and the heat exchanger is trapped between the rim and a jacking bolt.

14. A fabric treating machine according to claim 13, wherein the heat exchanger includes a perimeter flange, said flange being trapped between the rim and the jacking bolt.

15. A fabric treating machine, comprising:

an outer shell and a perforated spin tub, said spin tub and outer shell each being generally cylindrical and having front and rear ends, said front end of said outer shell being covered by a front shell head and said rear end of said outer shell being covered by a rear shell head, said front shell head having a an opening formed therein;

a removable heat exchanger, said heat exchanger being removably mounted within said machine intermediate said perforated spin tub and said outer shell, said heat exchanger comprising spacers to maintain the heat exchanger a distance from an inner surface of said outer shell;

mounting means for removably mounting the heat exchanger to said outer shell, said mounting means including heat exchanger guide means and retainer means, said guide means guiding the heat exchangers during installation and removal, and said retainer means retaining the heat exchangers in position relative to the spin tub during operation of the machine, wherein a heat exchanger access cover is provided by the heat exchanger, said access cover being removably mounted to the front shell head and providing ports for the fluid communication of a heat exchanging medium between an interior of the heat exchanger and an exterior of the machine, said heat exchanger being removed from said washing machine by detaching the access cover from the front shell head and pulling the heat exchanger out through the opening in the front shell head.

16. A fabric treating machine according to claim 15, wherein said mounting means includes a jacking bolt, said jacking bolt being operable to trap the heat exchanger between the jacking bolt and the retainer means.

17. A fabric treating machine according to claim 16, wherein the guide means comprises a guide clip and the retainer means comprises a retainer clip, said guide clip being attached to the outer shell and said retainer clip being attached to the rear shell head.

18. A fabric treating machine, comprising:

an outer shell and a perforated spin tub, said outer shell having a generally cylindrical body, a front shell head covering a front end of the outer shell body, a rear shell head covering a rear end of the outer shell body, and an aperture formed in the outer shell body intermediate the front and rear ends thereof;

a side pocket secured to said outer shell body, said side pocket generally surrounding said aperture and being adapted to slidably receive a heat exchanger; and, means for removably mounting the heat exchanger to the outer shell, said mounting means including a jacking bolt, said heat exchanger being trapped between the jacking bolt and the outer shell.

19. A fabric treating machine according to claim 18, wherein said heat exchanger comprises an access cover, said access cover including inlet and outlet port connections to allow fluid communication of a heat exchanging medium with an interior of the heat exchanger.

20. A fabric treating machine according to claim 19, wherein the side pocket includes a lower end which generally merges with the outer shell body and an upper end which is spaced from the outer shell body, said access cover being removably attached to the side pocket at the upper end.

* * * * *